US005415798A

United States Patent [19]

Pease et al.

[11] Patent Number: 5,415,798

[45] Date of Patent: May 16, 1995

[54] CONCENTRATED HIGH FLASH POINT SURFACTANT COMPOSITIONS

[75] Inventors: Jacqueline K. Pease; David D. Dreisbach, both of Jacksonville, Fla.

[73] Assignee: Betz PaperChem Inc., Jacksonville, Fla.

[21] Appl. No.: 182,814

[22] Filed: Jan. 14, 1994

[51] Int. Cl.[6] ..... C11D 7/08; C11D 1/83

[52] U.S. Cl. ..... 252/142; 252/550; 252/551; 252/174.21

[58] Field of Search ..... 252/142, 174.21, 174.22, 252/550, 551, 554

[56] References Cited

U.S. PATENT DOCUMENTS

| | | | |
|---|---|---|---|
| 3,893,955 | 7/1975 | Hewitt et al. | 252/551 |
| 4,210,571 | 7/1980 | Herman | 260/40 R |
| 4,285,841 | 8/1981 | Barrat et al. | 252/559 |
| 4,772,426 | 9/1988 | Koch et al. | 252/549 |
| 5,057,246 | 10/1991 | Bertho et al. | 252/545 |

FOREIGN PATENT DOCUMENTS

| | | |
|---|---|---|
| 991502 | 6/1976 | Canada . |
| 109022 | 5/1984 | European Pat. Off. . |
| 243685 | 11/1987 | European Pat. Off. . |

*Primary Examiner*—Paul Lieberman
*Assistant Examiner*—Lorna M. Douyon
*Attorney, Agent, or Firm*—Alexander D. Ricci; Philip H. Von Neida

[57] ABSTRACT

Disclosed are concentrated high flash point surfactant compositions comprising an alcohol ethosulfate free of low flash solvents, a primary alcohol ethoxylate and glacial acetic acid in a weight ratio of 5 to 80% alcohol ethosulfate, 80 to 20% alcohol ethoxylate and 2 to 20% acetic acid. Preferably, a fourth component consisting of a nonionic surfactant such as caster oil ethoxylate is employed in the composition.

12 Claims, No Drawings

CONCENTRATED HIGH FLASH POINT SURFACTANT COMPOSITIONS

FIELD OF THE INVENTION

The present invention pertains to concentrated surfactant compositions having high flash points. These stable compositions provide utility in a variety of papermaking operations.

BACKGROUND OF THE INVENTION

Combinations of surfactants, such as anionic and nonionic surfactants, have proven useful in industries such as papermaking to provide detergency, wetting, dispersancy, and emulsification.

Traditionally, alkyl phenol ethoxylates have been used in these surfactant blends but have come under environmental pressure from European countries and the Great Lakes region of the United States as being less biodegradable than other surfactants. Surfactants such as alcohol ethoxylates and their derivatives should experience increased use as more environmentally sound substitutes for alkyl phenol ethoxylates and their derivatives.

Concentrated surfactant blends are most desirable for economic reasons. Unfortunately, concentrated liquid blends containing a high percentage of alcohol ethosulfate generally have low flash points as they are stabilized with ethanol to improve stability and handling characteristics. However, many industries such as the papermaking industry operate at high temperatures and cannot utilize materials having low flash points for safety reasons. Thus, the need to develop effective concentrated nonyl phenol free high flash products which were stable and capable of being pumped at temperatures as low as 40° F. The present inventive composition meets these objectives.

SUMMARY OF THE INVENTION

The present invention relates to concentrated surfactant compositions of alcohol ethosulfate free of low flash solvents and primary alcohol ethoxylate. Acetic acid is also incorporated in the mixture to keep the surfactants from gelling when combined.

Additionally, a fourth component, a nonionic surfactant, can be employed in the mixture to increase its stability and decrease its cold temperature viscosity.

DESCRIPTION OF THE RELATED ART

In European Patent Application EP 0-243-685 and EP 0-109-022, low molecular weight solvents such as alcohols, glycols, glycol ethers and ketones are used to make liquid detergents of anionic surfactants and nonionic surfactants. Alcohol ethosulfates and alcohol ethoxylates are taught as some of the effective surfactants.

U.S. Pat. No. 4,285,841 employs a low molecular weight phase regulant to combine fatty acids, sulfated or sulfonated anionic surfactant, and an ethoxylated nonionic surfactant to make a concentrated ternary detergent system. The phase regulant, essential for manufacture and stability, is either a low molecular weight aliphatic alcohol or ether.

U.S. Pat. No. 3,893,955 employs a salt of a low molecular weight carboxylic acid, rather than ethanol, to an alcohol ethosulfate concentrate so that it can be diluted with water without gelling. This can also include some free alkoxylated alcohol. Canada 991502 employs a $C_1$ to $C_6$ sulfate or sulfonate to control viscosity of an alcohol ethosulfate concentrate.

U.S. Pat. No. 4,772,426 employs a combination of higher molecular weight carboxylic acids, $C_8$–$C_{22}$, and alcohol ethoxylates to lower the viscosity of sulfonated alkyl esters.

DETAILED DESCRIPTION OF THE INVENTION

This invention discloses concentrated high flash point surfactant compositions comprising (a) an alcohol ethosulfate, (b) a primary alcohol ethoxylate and (c) glacial acetic acid.

The alcohol ethosulfate compounds are free of low flash point solvents so that the compositions can be employed in pulp and papermaking systems or other industrial applications where process temperatures can reach 150° F. and above. The National Fire Protection Association defines flammable liquids as those with flash points of 100° F. or less. As used herein, low flash point solvents are those having flash points of 100° F. or less.

The composition comprises 5 to 80% by weight alcohol ethosulfate and 20 to 80% by weight primary alcohol ethoxylate. 2 to 20% by weight acetic acid is incorporated in amounts that assure that the first two components do not gel upon combination with each other.

The alcohol ethosulfate can have chain lengths from about $C_8$ to about $C_{22}$ with degrees of ethoxylation from about 1 to about 30 moles per mole of alcohol. The preferred alcohol ethosulfate has an average chain length of about $C_{12}$ and having 1 to 4 moles ethylene oxide per mole of alcohol. The alcohol ethosulfate should be 60 to 90% actives and should be free of low flash solvents. These compounds are commercially available from Rhone Poulenc and Henkle.

The primary alcohol ethoxylate can have chain lengths from about $C_8$ to about $C_{22}$ with $C_{12}$ to $C_{16}$ being preferred. The degree of ethoxylation is from 1 to about 30 moles of ethoxylation per mole of alcohol with 5 to 10 moles of ethoxylation preferred. The primary alcohol ethoxylate should be about 90 to 100% actives. These compounds are commercially available from Shell, Texaco and Hoechst Celanese.

Preferably, the composition contains 30 to 45% by weight alcohol ethosulfate (21 to 32% actives if 70% actives ethosulfate), 35 to 55% by weight primary alcohol ethoxylate, and 4 to 10% by weight glacial acetic acid.

More preferably, a fourth component can be included in the composition at about 10 to 20%. This fourth component can be any nonionic surfactant other than an alkyl phenol ethoxylate and should differ in structure and/or degree of ethoxylation from the main nonionic component (primary alcohol ethoxylate). Examples of such nonionic surfactants are secondary alcohol ethoxylates, ethylene oxide/propylene oxide block copolymers, and caster oil ethoxylates. Preferably, this fourth component is caster oil ethoxylate. These components are preferably mixed together at approximately 125° F. to 150° F. to decrease the cold temperature viscosity to a pumpable level.

The compositions of the present invention provide enhanced removal of undesirable organics from pulp and papermaking systems. The inventors anticipate the compositions of the present invention will provide utility for detergency, wetting, dispersancy and emulsification in papermaking processes as well as many other potential industrial applications.

The following examples are included as being illustrations of the invention and should not be construed as limiting the scope thereof.

EXAMPLES

A 100% active linear primary alcohol ethoxylate (PAE) with 7 moles of ethylene oxide (EO) per mole of alcohol ($C_{12}$ to $C_{16}$) was combined with three types of alcohol ethosulfates to evaluate the state of the mixture at room temperature. In these examples, % actives refers only to the alcohol ethosulfate and primary alcohol ethoxylate actives. In some instances, water was added to some formulations. This quantity of water is the difference between weight % added and 100%. The types of alcohol ethosulfates used throughout the examples as Type A, Type B and Type C. These formulations are designated below:

Type A is 60% actives with 3 moles EO, 15% low flash solvent (ethanol)

Type B is 30% actives with 3 moles EO, 0% low flash solvent

Type C is 70% actives with 2 moles EO, 0% low flash solvent

These results are presented in Table I.

TABLE I

| Weight % Added | | | Final Formula | |
|---|---|---|---|---|
| Alcohol Ethosulfate | Primary Alcohol Ethoxylate | Third Component | % Actives | Form |
| 50.0% A[1] | 50.0% | 0% | 80.0% | Liquid |
| 50.0% B | 50.0% | 0% | 65.0% | Gel |
| 50.0% C | 50.0% | 0% | 85.0% | Gel |
| 45.5% C | 45.5% | 9.0% SC | 77.4% | Gel |
| 42.0% C | 42.0% | 8.0% SC | 71.4% | Gel |
| 42.0% C | 42.0% | 8.0% CA | 71.4% | Gel |
| 34.0% C | 52.0% | 7.0% CA | 75.8% | Gel |
| 41.0% C | 49.0% | 7.5% SG | 77.7% | Gel |
| 32.3% C | 64.5% | 3.2% AA | 87.1% | Liquid |
| 39.6% C | 52.7% | 7.7% AA | 80.4% | Liquid |
| 43.4% C | 47.2% | 9.4% AA | 77.6% | Liquid |
| 41.0% C[2] | 49.0% | 10.0% AA | 77.7% | Liquid |
| 40.0% C | 47.5% | 10.0% AA | 75.5% | Liquid |
| 39.0% C | 46.0% | 10.0% AA | 73.3% | Liquid |

SC is sodium citrate
CA is citric acid
SG is sodium gluconate
AA is acetic acid, glacial
[1]flashpoint measured at approximately 110° F.
[2]flashpoint measured at >200° F.

The data presented in Table I serves to illustrate that liquid products cannot be made by combining Type B and C ethosulfates with primary alcohol ethoxylate alone whereas Type A ethosulfate (containing ethanol) can. Further, sodium citrate and sodium gluconate, as taught in U.S. Pat. No. 3,893,955 did not work to make a liquid product. However, acetic acid produced a liquid formula each time it was used. The formulas employing acetic acid also had higher flash points than those using ethanol (Formula 1=110° F., Formula 2>200° F.).

Table II demonstrates the form of the mixture when different primary alcohol ethoxylates were combined with Type C ethosulfate and glacial acetic acid in the following ratio:

47.2% primary alcohol ethoxylate
9.4% acetic acid
43.4% Type C alcohol ethosulfate

TABLE II

| Primary Alcohol Ethoxylate | | Final Formula |
|---|---|---|
| Alcohol Chain Length | Moles EO | Form |
| $C_9$–$C_{11}$ | 6 | Liquid |
| $C_{12}$–$C_{15}$ | 3 | Liquid |
| $C_{12}$–$C_{15}$ | 7 | Liquid |
| $C_{12}$–$C_{15}$ | 12 | Liquid |
| $C_{14}$–$C_{15}$ | 13 | Liquid |

This table shows that acetic acid aids in keeping the combination of alcohol ethosulfate and (a wide range of) primary alcohol ethoxylates in liquid form at room temperature.

Further studies were conducted to determine if a four component mixture could remain liquid. The fourth component was selected from a variety of nonionic surfactants and added to the type C alcohol ethosulfate (AES)/primary alcohol ethoxylate (PAE)/acetic acid (AA) mixture. These results are reported in Table III.

TABLE III

| Weight % Added | | | | Final Formula | |
|---|---|---|---|---|---|
| AES | PAE | AA | Fourth Component | % Actives | Form |
| 34.8% | 44.8% | 4.5% | 15.9%[1] | 69.2% | Liquid |
| 35.0% | 45.0% | 4.0% | 16.0%[2] | 69.5% | Liquid |
| 38.9% | 38.9% | 5.6% | 16.6%[2] | 66.1% | Liquid |
| 35.7% | 42.9% | 3.6% | 17.8%[3] | 67.9% | Liquid |
| 39.2% | 39.2% | 5.9% | 15.7%[3] | 66.6% | Liquid |
| 38.0% | 38.0% | 5.0% | 19.0%[3] | 64.6% | Liquid |
| 38.0% | 38.0% | 11.0% | 13.0%[4] | 64.6% | Liquid |
| 34.3% | 44.1% | 5.9% | 15.7%[4] | 68.1% | Liquid |
| 34.2% | 39.0% | 7.3% | 19.5%[4] | 62.9% | Liquid |
| 29.4% | 38.2% | 7.0% | 22.8%[4] | 58.8% | Liquid |
| 15.0% | 65.0% | 7.0% | 13.0%[5] | 75.5% | Liquid |
| 5.0% | 75.0% | 7.0% | 13.0%[5] | 78.5% | Liquid |

PAE with 7 moles ethylene oxide (EO) and $C_{12}$ to $C_{16}$ alkyl chain lengths
[1]block copolymer of ethylene oxide and propylene oxide of the form EO-PO-EO with 10% EO available from BASF.
[2]caster oil ethoxylate with 5 moles EO per mole of caster oil available from Hoechst Celanese.
[3]secondary alcohol ethoxylate with 3 moles EO per mole of alcohol available from Union Carbide.
[4]primary alcohol ethoxylate with 1 mole of EO per mole of alcohol available from Hoechst Celanese
[5]caster oil ethoxylate with 40 moles of EO per mole of caster oil available from Rhone Poulenc.

In the following example, three and four component formulations were made employing type C laurel alcohol ethosulfate (AES), primary alcohol ethoxylate (PAE) with 7 moles EO per mole of C12 to C16 alcohol and glacial acetic acid (AA). The fourth component was selected from secondary alcohol ethoxylate (SAE) with 3 moles EO per mole of alcohol or caster oil ethoxylate (COE) with 5, 30 or 40 moles EO.

TABLE IV

| | Weight % Added | | | | | Final Formula % |
|---|---|---|---|---|---|---|
| Formula | AES | PAE | AA | SAE | COE | Actives |
| I | 41% | 49% | 10% | 0% | 0% | 77.7% |
| II | 38% | 38% | 6% | 18% | 0% | 64.6% |
| III | 35% | 45% | 4% | 0% | 16% (5 EO) | 69.5% |
| IV | 35% | 45% | 4% | 0% | 16% (30 EO) | 69.5% |
| V | 35% | 45% | 7% | 0% | 13% (5 EO) | 69.5% |
| VI | 35% | 45% | 7% | 0% | 13% (30 EO) | 69.5% |
| VII | 35% | 45% | 7% | 0% | 13% (40 EO) | 69.5% |

The viscosity of these final formulas was measured at different temperatures using a Brookfield viscometer (RVT spindle #4, 10 rpm) one to two days after formulation. In industrial applications it is desirable for a product to be easily pumped at lower temperatures. This should mean a viscosity around 3000 centipoise or lower. This is presented in Table V. If the formula was solid or nearly solid the viscosity was not measured. In these instances, NS (nearly solid) is reported for viscosity.

In some instances, more than one version of the same formula was made using different batches of raw material or material from different suppliers. The ranges of viscosity shown in Table V refer to the range observed for these different versions of formulas. The formulas were processed at either 75° F. or 125° F.

TABLE V

| Formula | Number Prepared | Process Temp (°F.) | Formulation Viscosity (Centipoise) 75° F. | 50° F. | 40° F. |
|---|---|---|---|---|---|
| I | 8 | 75 | 300–1400 | 900–3000 | N.S. |
| I | 3 | 125 | 440–640 | 1100–1560 | 2100–N.S |
| II | 5 | 75 | 800–1540 | 1840–3140 | N.S. |
| II | 6 | 125 | 240–600 | 500–1260 | 1040–2760 |
| III | 3 | 75 | 900–1760 | 2000–4500 | N.S. |
| III | 1 | 125 | 1500 | 3440 | N.S. |
| IV | 1 | 75 | 1040 | 2060 | 4000 |
| V | 1 | 125 | 400 | 760 | 1100 |
| VI | 3 | 75 | 1100–2000 | 1960–3500 | 2600–N.S. |
| VII | 2 | 75 | 1100–1840 | 1840–3100 | 3400–N.S. |
| VII | 7 | 125 | 300–600 | 740–1500 | 1300–2500 |

The addition of the fourth component generally decreased the cold temperature viscosity of these formulations when they were processed at the elevated temperature. It was necessary that the acetic acid level be greater than 4% to notice this advantage.

Typically, process equipment will contain some remnant wash water that will contaminate mixtures when they are processed. The amount of this contaminant water would likely be approximately 0.5–1%. The effect of contaminant water was analyzed on formulas I, II and VII from Table IV, by adding water (an amount equal to 1 weight percent of the formulation) to the mixing vessel prior to formulation. The viscosities of these formulations are contained in Table VI.

TABLE VI

| Formula ID | Process Temperature (F.) | Viscosity (Centipoise) 70° F. | 50° F. | 40° F. |
|---|---|---|---|---|
| I | 125 | 700 | 2200 | N.S. |
| II | 125 | 400 | 1500 | N.S. |
| VII | 125 | 400 | 1000 | 1800 |

A comparison of Tables V and VI reveals that the caster oil ethoxylate continued to decrease the cold temperature viscosity even in the presence of contaminant process water, whereas, secondary alcohol ethoxylate did not.

A comparative study was performed to determine the ability of the present composition to stabilize calcium oleate salts. For this study, the products were added to a system containing 50 ppm sodium oleate, 100 ppm $Ca^{+2}$ with a pH of 9 and incubated at 71° C. or 88° C. for 30 minutes. The transmittance of the test solutions was measured to determine the degree to which the formula was able to stabilize the insoluble salts against agglomeration. The products in these examples were added on an equal cost basis and not equal actives basis. Thus, dosages will not be equal. These results are reported in Table VII.

TABLE VII

| Formula | 71° C. Actual Dosage (ppm) | 71° C. % Increase in Transmittance | 88° C. Actual Dosage (ppm) | 88° C. % Increase in Transmittance |
|---|---|---|---|---|
| I | 24 | 83% | 47 | 75% |
| II | 22 | 89% | 43 | 78% |
| VII | 22 | 81% | 45 | 74% |
| PVA[1] | 72 | 16% | 144 | 8% |
| NPE[2] | 27 | 74% | 54 | 46% |

[1]PVA is polyvinyl alcohol (10% actives product) as described in U.S. Pat. No. 4,871,424.
[2]NPE is nonyl phenol ethoxylate (90% actives product) as described in U.S. Pat. No. 2,716,058.

The example shown in Table VII represents only one of the possible utilities of products described by this invention.

Formulations I, II and VII, from Table IV, were relatively stable formulations, however, occasionally, there was some separation at elevated temperatures (122° F.). Table VIII depicts how often this separation occurred for these formulas.

TABLE VIII

| Formula ID | SEPARATION at 122° Number of Versions | Number Separated | Percent that Separated |
|---|---|---|---|
| I | 12 | 6 | 50% |
| II | 13 | 2 | 15% |
| VII | 10 | 2 | 20% |

Table VIII illustrates the advantage of a fourth nonionic surfactant component for added product stability.

The visual separation that these mixtures experienced was not a separation of the main components as there was not a difference in the performance of the product at the top of a formulation as compared to the bottom portion. This point is demonstrated in Table IX which is a comparison of the performance of the top portion of a formula exhibiting this visual separation compared to the bottom portion. Performance was judged using the same procedure as described in Table VII, at 71° C. using 25 ppm product.

TABLE IX

| EFFECT OF SEPARATION ON PERFORMANCE Formula ID | Percent Increase in Transmittance Top Portion | Bottom Portion |
|---|---|---|
| I | 72% | 70% |
| II | 70% | 70% |
| VII | 81% | 80% |

Based on the results in Table IX, the apparent separation these formulations occasionally display is not an issue since there is not a difference in performance from the top to the bottom of the formulation. As Table VIII shows, the use of a fourth component helps decrease the number of these incidences.

To demonstrate how a formulation such as this would be fed into an aqueous industrial stream 1 ml of formula VII from Table IV was added to 150 mls deionized water or diluted black liquor stirring at a moderate rate with a magnetic mixer. The black liquor, the liquid remaining after wood chips are pulped containing organics (mainly lignin) and spent cooking chemicals, was diluted to roughly 0.2% dissolved solids. The time necessary to dissolve the formulation at various temperatures is recorded in Table X.

TABLE X

| TIME NECESSARY TO DISSOLVE FORMULATION VII | | |
|---|---|---|
| Temperature | Deionized Water | Diluted Black Liquor |
| 27° C. | 233 sec | 314 sec |
| 38° C. | 123 sec | — |
| 50° C. | 66 sec | — |
| 55° C. | 23 sec | 23 sec |
| 62° C. | 6 sec | — |
| 65° C. | — | 2 sec |

Table X demonstrates that formulations of this type can easily be dissolved in industrial process streams that are at least 55° C.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A concentrated surfactant composition having a flash point greater than 100° F. consisting essentially of (a) an alcohol ethosulfate free of solvents having flash points lower than 100° F., (b) a primary alcohol ethoxylate, (c) glacial acetic acid, wherein the weight ratio of (a):(b):(c) is 5 to 80%:80 to 20%:2 to 20% and (d) optionally 10 to 20% by weight of a second nonionic surfactant other than an alcohol ethoxylate, said composition having at least about 58% actives.

2. The composition as claimed in claim 1 wherein said alcohol ethosulfate has an alkyl carbon chain length of from about $C_8$ to about $C_{22}$.

3. The composition as claimed in claim 1 wherein said alcohol ethosulfate has from about 1 to about 30 moles ethoxylation per mole of alcohol.

4. The composition as claimed in claim 1 wherein said alcohol ethosulfate has an alkyl carbon chain length averaging $C_{12}$ and 1 to 4 moles ethoxylation per mole of alcohol.

5. The composition as claimed in claim 1 wherein said primary alcohol ethoxylate has a carbon chain length of from about $C_8$ to about $C_{22}$.

6. The composition as claimed in claim 1 wherein said primary alcohol ethoxylate has from about 1 to about 30 moles ethoxylation per mole of alcohol.

7. The composition as claimed in claim 1 wherein said primary alcohol ethoxylate has an alkyl carbon chain length of from $C_{12}$ to $C_{16}$ and 5 to 10 moles ethoxylation per mole of alcohol.

8. The composition as claimed in claim 1 wherein the weight ratio of (a):(b):(c) is 30 to 45%:35 to 55%:4 to 10%.

9. The composition as claimed in claim 1 wherein the second nonionic surfactant is selected from the group consisting of a secondary or primary alcohol ethoxylate, a caster oil ethoxylate and a block copolymer of ethylene oxide and propylene oxide.

10. The composition as claimed in claim 9 wherein said second nonionic surfactant is caster oil ethoxylate with 30 to 50 moles ethylene oxide per mole of caster oil.

11. The composition as claimed in claim 1 consisting essentially of weight 30 to 45% alcohol ethosulfate, 35 to 55% primary alcohol ethoxylate, 4 to 10% glacial acetic acid and 10 to 20% second nonionic surfactant.

12. The composition as claimed in claim 1 wherein said composition is mixed together at 125° F. to 150° F.

* * * * *